United States Patent [19]

Swigert

[11] 4,449,235

[45] May 15, 1984

[54] ELECTRONIC CANCELLING OF ACOUSTIC TRAVELING WAVES

[75] Inventor: Charles J. Swigert, Pacific Palisades, Calif.

[73] Assignee: The United States of America as represented by the Secretary of the Air Force, Washington, D.C.

[21] Appl. No.: 398,131

[22] Filed: Jul. 14, 1982

[51] Int. Cl.[3] ..... H04R 1/28

[52] U.S. Cl. ..... 381/71; 381/94

[58] Field of Search ..... 181/198, 206; 381/71, 381/94

[56] References Cited

U.S. PATENT DOCUMENTS

| | | | |
|---|---|---|---|
| 3,602,331 | 8/1971 | Bschorr | 181/33 L |
| 3,936,606 | 2/1976 | Wanke | 179/1 P |
| 4,044,203 | 8/1977 | Swinbanks | 179/1 P |
| 4,122,303 | 10/1978 | Chaplin et al. | 179/1 P |
| 4,177,874 | 12/1979 | Angelini et al. | 181/206 |

OTHER PUBLICATIONS

"An Experimental Study of Swinbanks' Method of Active Attenuation of Sound in Ducts", Journal of Sound and Vibration (1976) 49(2), 257–266.

*Primary Examiner*—Harold I. Pitts
*Assistant Examiner*—James L. Dwyer
*Attorney, Agent, or Firm*—Donald J. Singer; Bernard E. Franz

[57] ABSTRACT

An acoustic disturbance in a thin support rod may be suppressed by detecting the disturbance, and processing the detected signal with electronic circuits to generate two output signals, which are injected into the rod at spatially separate positions. It is the solution of the waveforms for the output signals that is the essence of the technique. The principal component of the electronic circuits is an integrator. There are also delay devices and summing circuits.

7 Claims, 3 Drawing Figures

ELECTRONIC CANCELLING OF ACOUSTIC TRAVELING WAVES

RIGHTS OF THE GOVERNMENT

The invention described herein may be manufactured and used by or for the Government of the United States for all governmental purposes without the payment of any royalty.

BACKGROUND OF THE INVENTION

This invention relates to electronic cancelling of acoustic traveling waves, and more particularly to the cancellation of relatively low to medium frequency range acoustic waves in a thin rod.

One field of use is the isolation of a strong acoustic source, such as a high energy laser device, from an acoustically fragile structure.

Any object that vibrates and disturbs its surrounding ambient medium may become an acoustic source by radiating acoustic waves which vary in wavelength. Very often, the vibration is unwanted and is a source of acoustic noise. The prior art has been concerned with such noise as may be radiated for example from reverberating structures, vibrating machinery, large transformers and various other large types of apparatus in various ambient mediums.

The most direct means for reducing the sound intensity from a typical acoustic source is to surround the source with an acoustic baffle which cuts off its direct acoustic propagation path. Various absorbing materials exist which have the ability to dissipate sound energy to heat energy. Such absorbers work well for the high frequency range, however, they are extremely bulky and limited in application for the low frequency range.

There is also a common problem in systems such as gimbals that have a torquer drive motor separated from the rate and position sensors by the mechanical structure of the gimbal. If the gimbal is flexible and has one or more resonant modes, then resonant peaks will be seen in the torquer response. If the frequency of the resonance is low enough, and the mechanical Q of the structure is high enough, this resonance can be a source of torquer control loop oscillations and sometimes even result in a loss of loop control. Even if the resonance problem is not severe enough to produce oscillation, it can still have a significant effect on the torquer response. As a result, the speed of response of the torquer control loop is usually limited by the lowest resonant frequency of the gimbal. The gimbal mechanical resonance problems are usually attacked by mechanical solutions, such as stiffening the structure, decreasing the inertia, or applying resonant or nonresonant dampers.

The various solutions mentioned above are *passive* techniques. There are also many known *active* techniques, using some form of electronic damping. A common type of noise cancellation arrangement employs a microphone, amplifier and loudspeaker to measure the noise and to produce equal amplitude and opposite phase acoustic signals to cancel out the sound.

In the case of the gimbal mechanical resonance problems, one electronic damping technique has energy inserted directly into the structure by a piezoelectric drive transducer, as reported in a paper by R. L. Forward, "Electronic Damping of Vibrations on Optical Systems", Applied Optics 18, 690–697 (1979). In another technique, the gimbal motor is used to supply the final power stage of the feedback damping loop. This electronic damping concept for control of gimbal torquer resonances involves placing a sensor (usually a piezoelectric strain transducer) on the mechanical structure to sense the impending excitation of the resonant mode by the forces from the torquer drive motor. These electrical signals are then amplified, phase shifted, and fed back into the torquer drive electronics at an appropriate summing point. With a proper choice of gain and phase, the modified torquer system operates as before, except that the resonant response has been reduced in amplitude and broadened in frequency just as if a mechanical damper had been placed on the gimbal structure.

R. L. Wanke in U.S. Pat. No. 3,936,606 describes an "acoustic Abatement Method and Apparatus". He points out that an antiwave which is 180° out of phase with respect to an acoustic wave, although it will cancel the intermediate portion of a pure sine wave, it will not cancel the first half cycle of an acoustic wave, nor the last half cycle of a locally generated antiwave. When the acoustic wave has a nonsymmetrical pressure variation, a 180° phase shift does not cancel the acoustic wave but in fact adds to the total objectionable sound energy. He alleges that complete cancellation by wave interference requires the use of an antiwave which is in phase and of mirror symmetry with respect to the acoustic wave to be cancelled. His patent covers a system for generating and introducing a mirror symmetry antiwave into the gas flow of a gas turbine.

Swinbanks Pat. No. 4,044,203 discloses a system for active control of soundwaves wherein sound sources spaced along a duct generate two waves traveling in opposite directions. Those waves traveling in the same direction as the unwanted wave sum to give a result which interferes directly with the unwanted wave while those traveling in the opposite direction sum to give a negligible result.

Coxan et al U.S. Pat. No. 3,602,331 discloses an apparatus for attenuating a sound wave propagating in a given direction along a duct.

Other references which describe several techniques for active cancelling of sound in ducts are: (1) J. H. B. Poole and H. G. Leventhal, "An Experimental Study of Swinbank's Method of Active Attenuation of Sound in Ducts", Journal of Sound and Vibration, 49 (2), 1976, pp. 257–266; (2) H. S. Leventhal, "Development in Active Attenuators", 1976 Noise Control Conference, Warsaw, Oct. 13–15, 1976; and (3) J. H. B. Poole and H. G. Leventhal, "Active Attenuation of Noise in Ducts", Journal of Sound and Vibration, 57 (2), 1978, pp. 308–309. These techniques use delay lines and phase shifters to phase shift the signal recorded by a microphone. High fidelity loudspeakers inject these phase shifted signals into the duct to actively cancel the incident sound.

Unfortunately, the reported frequency range of operation is relatively limited for these active cancelling techniques. Attenuation of 20 dB is reported over approximately an octave, e.g., 100 to 200 Hertz or 80 to 160 Hertz with about 35 dB attenuation at a selected frequency.

Patents which disclose other sound control systems and techniques of interest include Andre et al, U.S. Pat. No. 4,255,083, Angelini et al U.S. Pat. No. 4,177,874, Davidson U.S. Pat. No. 4,025,724, Bschorr U.S. Pat. No. 3,602,331, Behrend U.S. Pat. No. 4,096,454, and McCormack U.S. Pat. No. 3,757,235.

In general, techniques of the prior art provide moderate cancellation of steady state vibrations at selected frequencies, or over small frequency bands.

SUMMARY OF THE INVENTION

An object of the invention is to provide improved attenuation of *transient* acoustic traveling waves over a very broad low frequency range. A particular object is to provide such attenuation in a medium such as a slender rod.

The electronic canceller according to the invention includes an integrator, delay devices, and other electronic devices. The electronic circuit is coupled to the acoustic medium via three transducers, two located at the same linear position and the other a predetermined distance downstream. The arrangement is such that an incident wave detected by one of the two transducers at the one position includes the original wave, a first output signal, and a second output signal delayed by traveling the predetermined distance. The detected and two output waves are combined electronically to derive the original wave, which is integrated over time to provide the second output signal. The output of the integrator is also delayed and passed through a minus-one device to obtain the first output signal. Providing the proper waveform for the two output signals is the essence of the invention.

For the longitudinal mode in a thin aluminum or steel rod, if the predetermined distance is less than 39 centimeters, the attenuation is at least 40 dB for frequencies below 500 Hertz. The lower frequency limit of performance will be established by the transducers, and may be 2 Hertz, or even 0.2 Hertz.

The technique allows isolation of a strong acoustic source, such as a high energy laser device, from an acoustically fragile structure, such as a large beam expander and pointer/tracker telescope. No comparable technique provides such strong isolation over this low to medium frequency range.

DETAILED DESCRIPTION

Figure 1:
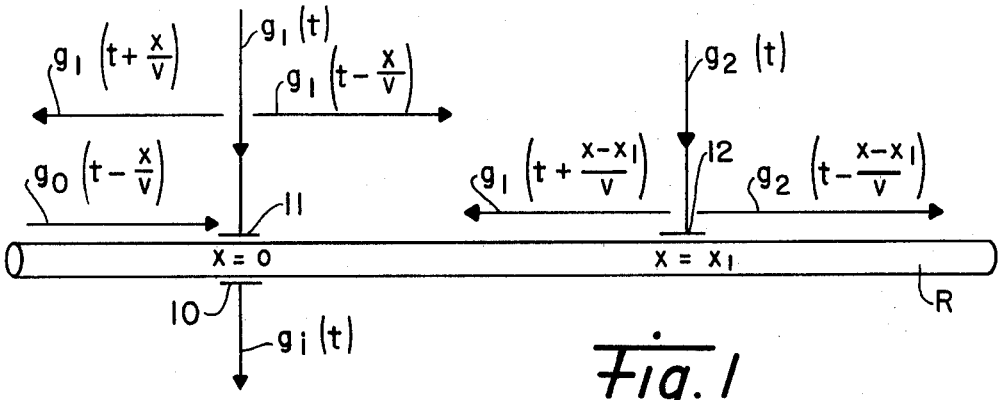
FIG. 1 is a symbolic diagram showing acoustic traveling waves and three transducers on a thin rod.

FIG. 1 shows a thin rod R in which an acoustic disturbance $g_0$ appears. This signal is processed to generate the two output signals $g_1$ and $g_2$, which are injected into the rod at spatially separate positions. The wave $g_0$ moving to the right combines with the waves $g_1$ and $g_2$ moving to the right to sum to zero. The two drive signals $g_1$ and $g_2$ moving to the left also combine to sum to zero. It is the solution of waveforms $g_1$ and $g_2$ that is the heart of the technique.

The thin rod R may by way of example be a support rod in a system which includes a high energy laser device, a large beam expander, and a pointer/tracker telescope.

Figure 2:
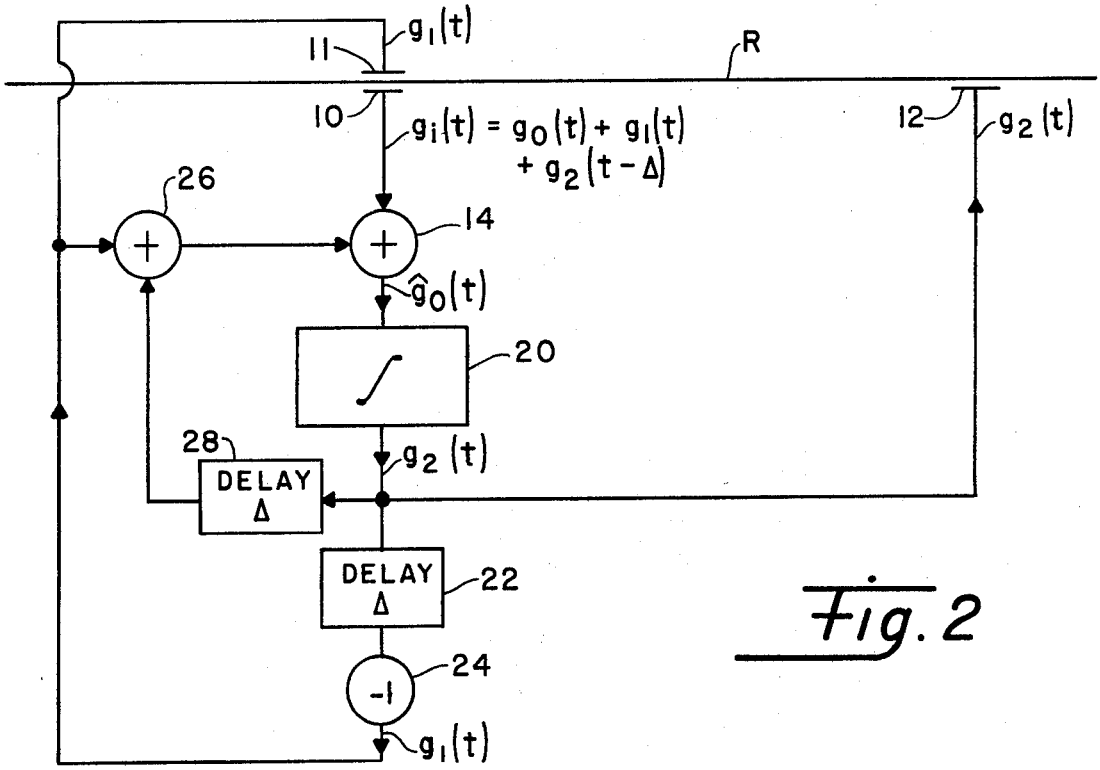
FIG. 2 is a block diagram of an electronic canceller, showing the signal flow to cancel an acoustic wave.

FIG. 2 is a functional block diagram of the electronic canceller circuit. The principal circuit is an integrator 20. The incident wave $g_i$ is detected by a transducer 10 coupled to a plus input of a summer 14. The output of summer 14 supplies the input signal for the integrator 20. The output of the integrator is the output signal $g_2$, which is supplied to transducer 12. The output of the integrator is also passed through a delay device 22 and a minus-one circuit 24 to provide the output signal $g_1$, which is supplied to the transducer 11 and also to a plus input of a summer 26. The output signal $g_2$ is also applied via a delay device 28 to another plus input of summer 26. The output of summer 26 is supplied to a minus input of summer 14.

As shown in FIG. 1, the two transducers 10 and 11 are located at a position $x=x_0$ of the rod R, while the transducer 12 is located at a position to the right, $x=x_1$. The delay devices 22 and 28 provide the same delay time designated $\Delta$. This is the time in which an acoustic wave travels between the positions $x_0$ and $x_1$. The inverted v in the designation $\hat{g}_0$ at the output of summer 14 and in the integrator 20 indicates that the signal is an estimation of the original signal $g_0$.

A caveat should be mentioned here about the performance of the electronic canceller. The technique assumes that the acoustic time delay between two transducers on the rod is well known. However, the acoustic velocity of longitudinal waves tends to be about twice the acoustic velocity of shear waves in many different materials. We will need a cancelling circuit for each of the different velocity waves we wish to cancel. We can discriminate between the longitudinal and the shear waves by using different transducers (or properly orienting them) so they see only the desired traveling wave mode.

FIG. 1 illustrates the incident acoustic traveling wave $g_0(t-x/V)$. The wave is assumed to travel on the thin rod without dispersion. Acoustic transducers are located at positions $x=0_1$ and $x=x_1$ and launch acoustic waves $g_1(t)$ and $g_2(t)$, respectively, into the rod. Another acoustic transducer at $x=0$ senses the incident signal $g_i(t)$ containing $t_0$, $g_1$ and $g_2$.

$$g_i(t)=g_0(t)+g_1(t)+g_2(t-\Delta) \tag{1}$$

where is the time delay $$\Delta=x_1/V \tag{2}$$

and V is the acoustic velocity of the acoustic wave mode being sensed by the transducer.

FIG. 2 illustrates how signal $g_i(t)$ and $g_2(t)$ is operated on to obtain $g_0(t)$ and the transducer outputs $g_1(t)$ and $g_2(t)$. The waveforms $g_1(t)$ and $g_2(t-\Delta)$ are subtracted from $g_i(t)$ to obtain $g_0(t)$. This output, $\hat{g}_0(t)$, an estimate of $g_0(t)$, is integrated and scaled to yield $g_2(t)$. Delay and sign reversal of $g_2(t)$ yields $g_1(t)$.

How Electronic Cancelling Works

We wish the electronic canceller to not launch any waves to the left of the transducer at $x=0$. Similarly, we wish the signals launched from the two transducers to combine with $g_0(t)$ and yield zero signal for all $x>x_1$. The waves to the left of $x=0$, $g_L(t)$, and to the rights of $x=x_1$, $g_R(t)$, are of the following form:

$$g_L(t)=g_1(t)+g_2(t-\Delta) \tag{3}$$

$$g_R(t)=g_2(t)+g_1(t-\Delta)=g_0(t-\Delta) \tag{4}$$

From FIG. 2, we see that $$g_1(t)=-g_2(t-\Delta) \tag{5}$$

Hence $g_L(t)$ is zero by observation of Equations (3), (5). Equation (4) becomes $$g_R(t)=g_2(t)-g_2(t-2\Delta)+g_0(t-\Delta) \quad (6)$$

In FIG. 2, integrator 20 performs the operation $$g_2(t) = \frac{-1}{2\Delta} \int_{-\infty}^{t} g_0(\tau)d\tau \quad (7)$$

Substituting (7) into (6), we obtain $$g_R(t) = -\frac{1}{2\Delta} \int_{-\infty}^{t} g_0(\tau)d\tau + \frac{1}{2\Delta} \int_{-\infty}^{t-2\Delta} g_0(\tau)d\tau + g_0(t-\Delta) \quad (8)$$

or $$g_R(t) = g_0(t-\Delta) - \frac{1}{2\Delta} \int_{t-2\Delta}^{t} g_0(\tau)d\tau \quad (9)$$

If we approximate $g_0(\tau)$ with a Taylor series expansion about $\tau=t-\Delta$, $$g_0(\tau)=g_0(t-\Delta)+\dot{g}_0(t-\Delta)\cdot[\tau-(t-\Delta)]+\tfrac{1}{2}\ddot{g}(t-\Delta)\cdot[\tau-(t-\Delta)]^2 \quad (10)$$

Then $$g_R(t) = -\frac{\Delta^2}{6}\ddot{g}(t-\Delta) \quad (11)$$

By taking the time delay between transducers small, we can make $g_R(t)$ be very small.

For a physical interpretation of how the canceller works, $g_0$ is integrated to form $g_1$ and $g_2$. The signals $g_1$ and $g_2$ combine in the rod to cancel (going to the left) or difference (going to the right) and form a negative derivation of the integral of $g_0(t)$. These two waveforms sum with an epsilon error due to the higher even derivatives of $g_0(t)$. A frequency analysis offers a better approximation of the actual error to be expected.

Frequency Analysis of Cancelling Error

Let $g_0(t) = A \cos wt$ (12)

Then $g_2(t) = \frac{-A}{2\Delta W} \sin wt$ and (13)

$$g_1(t) - \frac{A}{2\Delta W} \sin w(t-\Delta) \quad (14)$$

From Equation (4)

$$g_R(t) = -\frac{A}{2\Delta w} \sin wt + \frac{A}{2\Delta w} \sin w(t-2\Delta) + A \cos w(t-\Delta) \quad (15)$$

with some manipulation of trigonometric expressions $$g_R(t) = A \cos w(t-\Delta)\left[1 - \frac{\sin(w\Delta)}{w\cdot\Delta}\right] \quad (16)$$

Using the approximation $$\sin(w\cdot\Delta) = w\Delta - \frac{(w\cdot\Delta)^3}{3!} \quad (17)$$

Equation (16) becomes $$g_R(t) = g_0(t-\Delta)\frac{(w\cdot\Delta)^2}{6} \quad (18)$$

For 40 dB of attenuation of 500 Hz, we require in Equation (18) that $$0.01 = \frac{(w\cdot\Delta)^2}{6}\Big|_{w=2\pi(500\text{ Hz})} \quad (19)$$

Hence, we require a time delay no longer than $$\Delta_{min} = 78\ \mu\text{sec} = \frac{X_{min}}{V} \quad (20)$$

The acoustic phase velocity of the longitudinal mode in both aluminum and steel is greater than $5\times10^5$ cm/sec. Hence $$X_{min}=V\Delta_{min}\,|\,V=5\times10^5\text{ cm/sec}=39.0\text{ cm} \quad (21)$$

Equation (21) says that as long as the distance between the output transducers, $X_1$, is less than 39 cm, we get at least 40 dB of attenuation for frequencies below 500 Hz. The lower frequency limit of performance will be established by the transducers.

Caveats

As noted, the canceller must know the time delay $\Delta$ between $x=0$ and $x=x_1$ for the traveling wave mode being cancelled. The canceller is a linear operation, so if the transducers do not see the other modes, they will not be affected (by the principle of superposition).

The canceller does not like signals coming from the right. This is a leftist canceller. If you want a rightest canceller, move the transducer at position $x=x_1$ to position $x=-x_1$.

In the leftist canceller, signals from the left are cancelled rather nicely (assuming ideal transducers, etc.). Signals $g_0(t)$ from the right will pass right through without being cancelled or perturbed. However, signal $-g_0(t-x/V)$ will be launched to the left. The resultant signal at position x(for $x>x_1$), with $g_0(t+x/V)=A \sin w(t+x/V)$, is $$g_R(t)=g_0(t+x/V)-g_0(t-x/V)=2A\cos(wt)\sin(wx/V) \quad (22)$$

The resultant waveform has doubled the peak amplitude with a lot of nulls located at $x_n=nV/2f$. Clearly $g_R(t)$ is not zero. Using two cancellers back to back will allow a cancellation of signals from the right or from the left.

Circuit Details

The transducers 10, 11 and 12 are preferably piezoelectric devices. Piezoelectric strain gauges, in a lead zirconate titanate composition provide a lower frequency limit of 0.0 Hertz (d.c.). An example of a suitable commercially available device is the Piezo Electric Products SG-4M transducer. The summers 14 and 26 and the minus-one device 24 may be implemented with well known operational amplifier circuits. The minus-one device uses the minus input of a differential operational amplifier. The delay devices 22 and 28 may be selected from many types, such as continuous delay lines, lumped circuits, mechanical delay devices, or quartz devices.

Figure 3:
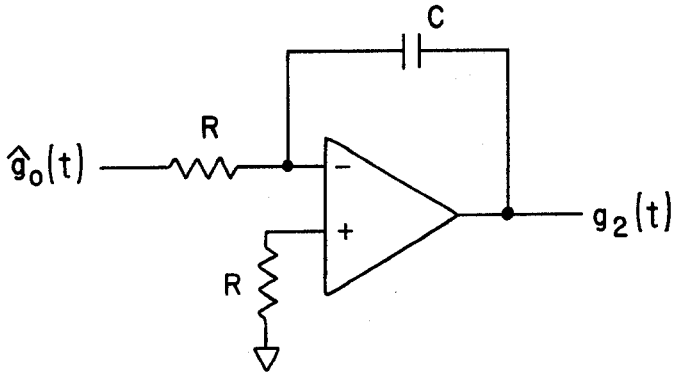
FIG. 3 is a diagram showing a circuit for performing the integration represented by a block in FIG. 2.

The integrator 20 may use an operational amplifier with appropriate external circuit components. An example using an integrated circuit type operational amplifier with other circuit components is shown in FIG. 3. This circuit performs the operation $$g_2(t) = \frac{-1}{RC} \int^{t} \hat{g}_0(\tau)d\tau \tag{23}$$

therefore, from equation (7), the time constant RC is equal to $2\Delta$.

Thus, while preferred constructional features of the invention are embodied in the structure illustrated herein, it is to be understood that changes and variations may be made by the skilled in the art without departing from the spirit and scope of my invention.

I claim:

1. Apparatus for attenuating a selected acoustic wave mode of an acoustic disturbance traveling in a given direction in a medium, said apparatus comprising an input transducer for detecting acoustic wave energy at a first position along the medium to produce an input electric signal, processing means for performing operations on the input signal in electronic circuits to generate first and second output signals at first and second outputs respectively, output transducer means for converting the two output signals to acoustic wave energy and injecting them into said medium at spatially separate positions, said output transducer means comprising a first transducer located at said first position and a second transducer located at a second position in said given direction from the first position, said first and second outputs being coupled to the first and second transducers, respectively;

wherein said electronic circuits include summing means having an input from said input transducer, integrating means coupled from the summing means to said second output, first delay means in series with a minus-one circuit coupled from said second output to said first output and also to an input of the summing means, and second delay means coupled from the second output to an input of the summing means;

wherein said first and second delay means each provide a given delay time which is equal to the distance between said first and second positions divided by the velocity of the selected acoustic wave mode sensed by the input transducer and injected by said first and second output transducers, the output of the second delay means being a third signal which is equal to the second output signal as a function of time less said given delay;

wherein said summing means comprises means to generate a signal which is equal to the sum of the first output signal and third signal subtracted from said input electrical signal, so that its output is an estimate of said acoustic disturbance, and wherein the integrating means forms the integral over time of said estimate.

2. Apparatus according to claim 1, wherein said medium is a solid material having relatively small cross-section dimensions.

3. Apparatus according to claim 2, wherein the distance between said spatially separate positions is determined by the formula $$\text{desired attenuation} = (2\pi f\Delta)^2/6$$

where f is a selected maximum frequency and $\Delta$ is the acoustic delay between said positions for said selected mode, the minimum distance between said positions being equal to $\Delta$ times the acoustic phase velocity for the selected mode.

4. Apparatus according to claim 3, wherein said medium is aluminum or steel, and said selected mode is the longitudinal mode, so that for a maximum frequency of 500 Hertz, and an attenuation of at least 40 dB, the distance between said positions is less that 39 centimeters.

5. A method of attenuating an acoustic disturbance traveling in a given direction in a medium, comprising detecting acoustic wave energy at a first position along the medium to produce an input electronic signal, processing the input signal in electronic circuits to generate first and second output signals, and converting the two output signals to acoustic wave energy and injecting them into said medium at spatially separate positions;

wherein said processing includes delaying and performing a minus one operation on the second output signal to generate the first output signal, delaying the second output signal to generate a third signal, generating a signal which is equal to the sum of the first output signal and third signal subtracted from the input electronic signal as an estimate of said acoustic disturbance, and integrating the last said signal over time to generate the second output signal.

6. The method according to claim 5, wherein said integrating step comprises performing the integration $$\frac{-1}{2\Delta} \int_{-\infty}^{t} \hat{g}_0(\tau)d$$

where $g_0(\tau)$ is said estimation of the initial acoustic disturbance, and $\Delta$is the time delay in said medium between said spatially separate positions.

7. The method according to claim 6, wherein the integration step makes use of an operational amplifier connected with external resistance and capacitance to form an integrator with $2\Delta$ equal to RC.

* * * * *